US006925807B2

(12) United States Patent
Jones et al.

(10) Patent No.: US 6,925,807 B2
(45) Date of Patent: Aug. 9, 2005

(54) ACTUATOR CONTROL SYSTEM FOR HYDRAULIC DEVICES

(75) Inventors: Franklin B. Jones, Shrewsbury, MA (US); Stuart A. Jones, Wrentham, MA (US)

(73) Assignee: Comprehensive Power, Inc., Marlborough, MA (US)

( * ) Notice: Subject to any disclaimer, the term of this patent is extended or adjusted under 35 U.S.C. 154(b) by 118 days.

(21) Appl. No.: 10/628,602

(22) Filed: Jul. 28, 2003

(65) Prior Publication Data

US 2004/0069497 A1 Apr. 15, 2004

Related U.S. Application Data

(60) Provisional application No. 60/399,539, filed on Jul. 30, 2002.

(51) Int. Cl.[7] ..... E21B 1/00

(52) U.S. Cl. ..... 60/721; 166/53

(58) Field of Search ..... 60/721; 166/66.6, 166/53, 250.16; 175/104

(56) References Cited

U.S. PATENT DOCUMENTS

| | | | | |
|---|---|---|---|---|
| 5,755,296 A | | 5/1998 | Richardson et al. | |
| 5,957,213 A | * | 9/1999 | Loraas et al. | 172/2 |
| 6,510,902 B1 | * | 1/2003 | Prokop et al. | 173/1 |
| 6,662,881 B2 | * | 12/2003 | Domann | 172/272 |
| 6,691,435 B1 | * | 2/2004 | Schultz et al. | 37/234 |

* cited by examiner

*Primary Examiner*—Thomas E. Lazo
(74) *Attorney, Agent, or Firm*—Guerin & Rodriguez, LLP; William G. Guerin

(57) ABSTRACT

An apparatus and method for controlling an actuator system having an electrical actuator in hydraulic communication with a hydraulic actuator are described. The apparatus includes a controller module in communication with a source of electrical power and a transceiver. The transceiver is adapted for bi-directional wireless communication with a remote transceiver for the transfer of control data and feedback data. The controller module sends a control signal to the electrical actuator in response to control data received from the remote transceiver. The source of electrical power includes a hydraulic motor and an electrical generator to provide local electrical power from a hydraulic flow. Because the electrical power is generated locally and the control and feedback data are carried over the wireless link, no wires to remote locations are required.

26 Claims, 4 Drawing Sheets

ACTUATOR CONTROL SYSTEM FOR HYDRAULIC DEVICES

CROSS-REFERENCE TO RELATED APPLICATION

This application claims the benefit of the filing date of co-pending U.S. provisional patent application Ser. No. 60/399,539, filed Jul. 30, 2002, titled "Robotic Control Actuation System for Top Drive with Two Pass Rotary Seal," the entirety of which provisional application is incorporated by reference herein.

FIELD OF THE INVENTION

The invention relates generally to an apparatus and method for controlling hydraulic actuators. In particular, the invention relates to an apparatus and method for wireless control of hydraulic robotics of a top drive for oil well drilling.

BACKGROUND

In drilling operations, a top drive is used to apply torque to rotate a drill string. The top drive includes a variety of robotic actuators to access and maneuver pipe. These robotic actuators include, for example, elevators, links, grabbers and mud valves. The top drive is attached to the top of the drill string and is suspended in the mast of the drilling platform. The lower portion of the top drive rotates around the axis of the drill string. The upper portion of the top drive is attached to a torque track and does not rotate.

During operation, hydraulic fluid that passes through a high pressure rotary seal located between the upper and lower portions of the top drive is used to control the hydraulic actuators in the lower portion. The rotary seal includes one hydraulic channel for each actuator or feedback signal and an additional common return hydraulic channel. Each channel added to the rotary seal results in an increase in the size and cost of the seal. Additional channels also cause an increase in the drag torque. Consequently, interlocks and feedback signals that could improve operator safety and drilling efficiency are often not implemented. Such feedback could ensure that each actuator has functioned properly before enabling subsequent actuators, and could report the position of each actuator to the control system of the drill operator.

Systems with an electrical control apparatus located below the rotary seal have not been used because the fixed wiring precludes continuous rotation. Electrical slip rings are not practical because the system operates in a harsh environment where components are exposed to shock and vibration. Moreover, because slip rings can spark during operation, they are unsuitable for use in the explosive atmospheres that sometime occur during drilling operations.

Thus, there remains a need for an actuator control system that can control the rotating robotics of a top drive using a simple rotary seal with minimal hydraulic channels, and can transfer control data and power without electrical connections.

SUMMARY OF THE INVENTION

In one aspect, the invention features an apparatus for controlling an actuator system having an electrical actuator in hydraulic communication with a hydraulic actuator and a hydraulic source. The apparatus includes a source of electrical power, a controller module and a transceiver module. The controller module receives power through electrical communication with the source of electrical power. In addition, the controller module is in electrical communication with the electrical actuator. The transceiver is in communication with the controller module and is adapted for wireless communication with a remote transceiver. The wireless communication includes the transfer of control data and feedback data with the remote transceiver. The control module sends a control signal to the electrical actuator in response to the control data received from the remote transceiver. In one embodiment, the source of electrical power includes a hydraulic motor in communication with the hydraulic source and an alternating current (AC) generator in mechanical communication with the hydraulic motor. In a further embodiment the source of electrical power also includes a boost rectifier in electrical communication with the AC generator. In another embodiment, the apparatus includes a sensor in communication with the controller module.

In another aspect, the invention features an apparatus for controlling the operation of an actuator system of a top drive. The actuator system has an electrical actuator and a hydraulic actuator in hydraulic communication. The electrical actuator is in hydraulic communication with a hydraulic source through a rotary seal. The apparatus includes a source of electrical power, a first controller module in communication with the source of electrical power and the electrical actuator, and a first transceiver configured for communication with a second transceiver through a wireless communication link. The wireless communication link is used to transfer control data and feedback data. The first controller module sends a control signal to the electrical actuator in response to the control data.

In another aspect, the invention features a method of controlling an actuator system having a hydraulic actuator. The method includes providing a hydraulic flow to the actuator sytem and generating electrical power from the hydraulic flow at the actuator system. The method also includes receiving a data signal from a remote wireless transceiver and controlling the hydraulic actuator in response to the received data signal and the electrical power. In one embodiment, the method also includes transmitting a data signal from the actuator to the remote wireless transceiver.

BRIEF DESCRIPTION OF THE DRAWINGS

The above and further advantages of this invention may be better understood by referring to the following description in conjunction with the accompanying drawings, in which like numerals indicate like structural elements and features in the various figures. Primed numerals identify structural elements and features which are similar, but not necessarily identical, to structural elements and features designated by unprimed numerals. The drawings are not necessarily to scale, emphasis instead being placed upon illustrating the principles of the invention.

DETAILED DESCRIPTION

In brief overview, the present invention relates to an apparatus and method for controlling an actuator system. The actuator system includes electrical actuators which in turn control respective hydraulic actuators which, for example, can be part of a top drive system for drilling. A local source of electrical power generates electricity for a controller module. A wireless transceiver receives commands for controlling electrical and hydraulic actuators, and provides the commands to the controller module. No electrical connections are necessary other than those among the local source of electrical power, controller module, transceiver and actuators. In addition, the hydraulic actuators are locally coupled to a single hydraulic feed.

Figure 1:
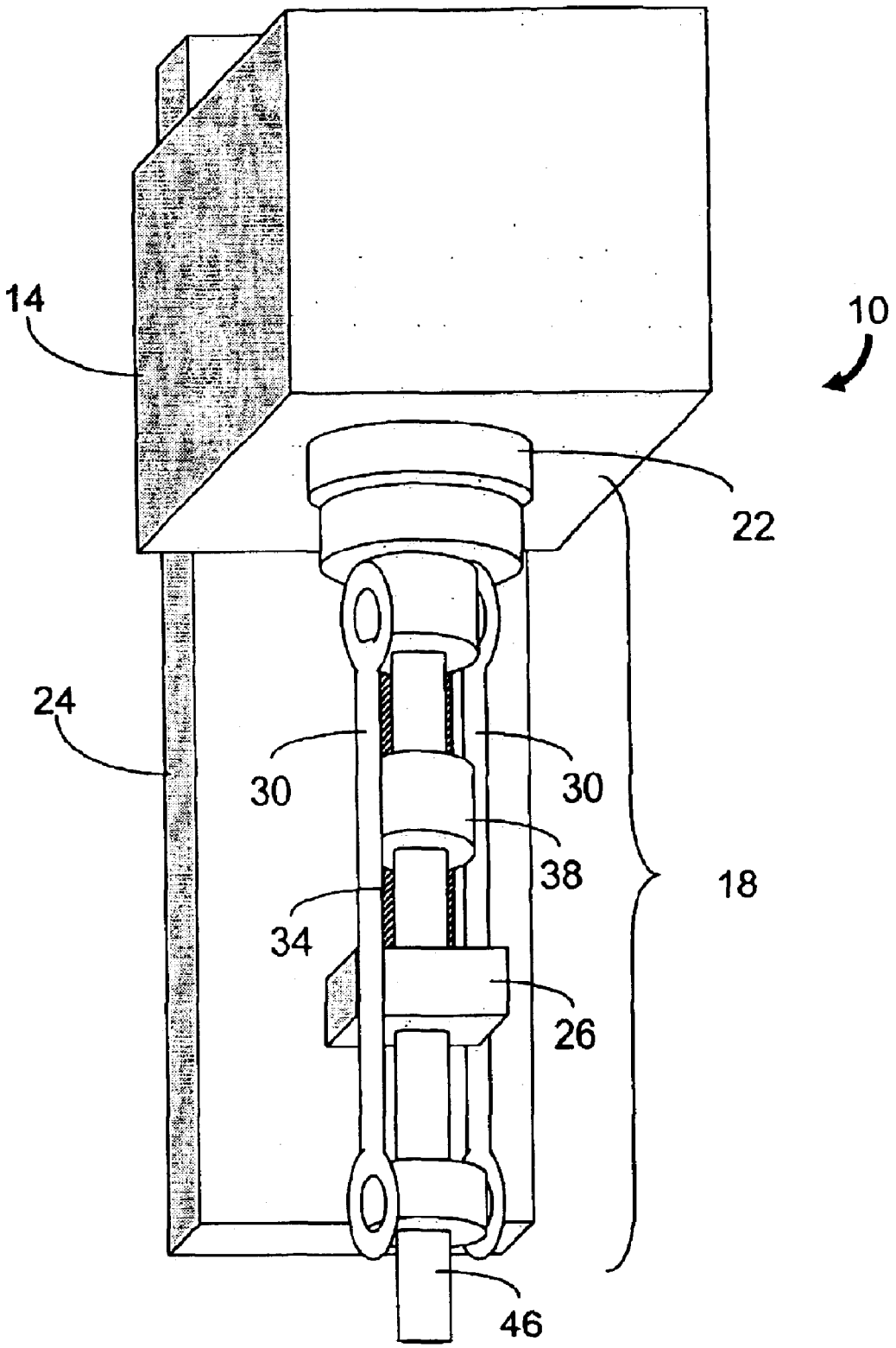
FIG. 1 is an illustration of various robotic units and other components in a top drive.

FIG. 1 is a simplified illustration of a top drive 10 for a drilling system showing various robotic positioning units. The top drive 10 includes a stationary portion 14 (i.e., upper portion) separated from a rotating portion 18 (i.e., lower portion) by a rotary seal 22. The stationary portion 14 typically includes multiple hydraulic actuators (not shown). The stationary portion 14 is mounted to a torque track 24 that acts as a reactive platform during drilling operations. The rotating portion 18 includes various hydraulic units such as a grabber 26 (i.e., backup wrench), elevators 30, a lifter 34 and a mud valve 38 as are known in the art. The rotating portion 18 can include other pipe positioning and processing equipment not shown here. Hydraulic fluid is provided from a hydraulic power generator (not shown) to the stationary portion 14. The rotary seal 22 conducts the hydraulic fluid between the stationary portion 14 and the rotating portion 18.

During operation, the grabber 26, elevators 30 and lifter 34 are used to bring a pipe 46 into position for attachment to the drill string or to hold the pipe stationary while making a connection to the drill string. For example, the lower portion 18 of the top drive 10 can rotate at low rates (e.g., less than 10 rpm) and the elevators 30 can extend outward to enable the top drive 10 to retrieve the pipe 46 from a nearby location (e.g., a mousehole).

Figure 2:
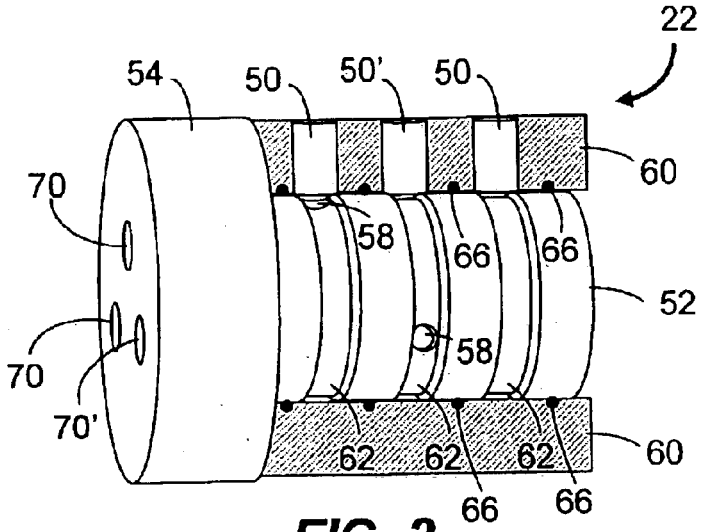
FIG. 2 is an illustration of a rotary seal used to pass hydraulic fluid between the stationary and rotating portions of a top drive.

FIG. 2A is an illustration of the rotary seal 22 used in the top drive 10 of FIG. 1. As depicted, the rotary seal 22 has only three hydraulic channels (corresponding to two inlet ports 50 and a return port 50') for clarity, however, it should be recognized that the rotary seal 22 typically has at least one channel for each hydraulic actuator in the rotating portion 18 and an additional channel for the return of the hydraulic fluid to the stationary portion 14. The rotary seal 22 includes a rotating cylindrical section 52 integral with a rotating end 54. A stationary section 60 surrounds the rotating cylindrical section 52. Hydraulic fluid from a hydraulic source passes through the inlet ports 50 in the stationary section 60 and flows into respective channels 62 (i.e., grooves) in the rotating cylindrical section 52. The hydraulic fluid passes through openings 58 in the respective grooves 62 and exits the rotary seal 22 through a respective exit port 70 in the rotating end 54. Hydraulic fluid received from the rotating portion of the top drive through inlet port 70' is conducted to an opening 58 and into the respective channel 62 before passing through the return port 50' in the stationary section 60. Each channel 62 is sealed from its adjacent channel 62 or the external environment by an internal seal 66.

Because there is no hydraulic control system in the rotating portion 18, each hydraulic actuator in the rotating portion 18 is controlled by a respective high pressure (e.g., 3,000 psi) hydraulic feed passing fluid through one of the channels in the rotary seal 22. Solenoid valves in the stationary portion 14 adjust the hydraulic flows of the individual channels. A single channel serves as a common return path for all of the hydraulic actuators. Complicated actuator systems can require many channels. For example, if the rotating portion 18 includes 12 actuators, the rotary seal 22 includes at least 13 channels. In addition, each feedback switch in the rotating portion 18 requires an additional channel.

Due to the high hydraulic pressure, the rotary seal 22 is subject to substantial drag and wear. If one of the channel seals 66 leaks, the rotary seal 22 must be removed from the top drive 10 and repaired, or else be replaced by another rotary seal 22. Repair of a rotary seal 22 can be difficult, especially if the defective seal requires the removal of other seals 22 in the repair process. Generally, the complexity of the repair increases more rapidly than the increase in the number of channels. Whether the rotary seal 22 is repaired or replaced, the result is costly and requires significant shutdown time. Consequently, the number of hydraulic actuators in the rotating portion 18 of a conventional top drive 10 is generally limited and the use of feedback sensors is minimal or nonexistent.

The present invention can use a rotary seal 22 having only two channels; one channel for receiving hydraulic fluid from the stationary section 14 and the other channel for returning hydraulic fluid to the stationary section 14. Reliable and complex motions are achieved by an increased number of hydraulic actuators in the rotating portion 18 of the top drive 10. In addition, the present invention allows for feedback sensors that result in increased operator safety.

Figure 3:
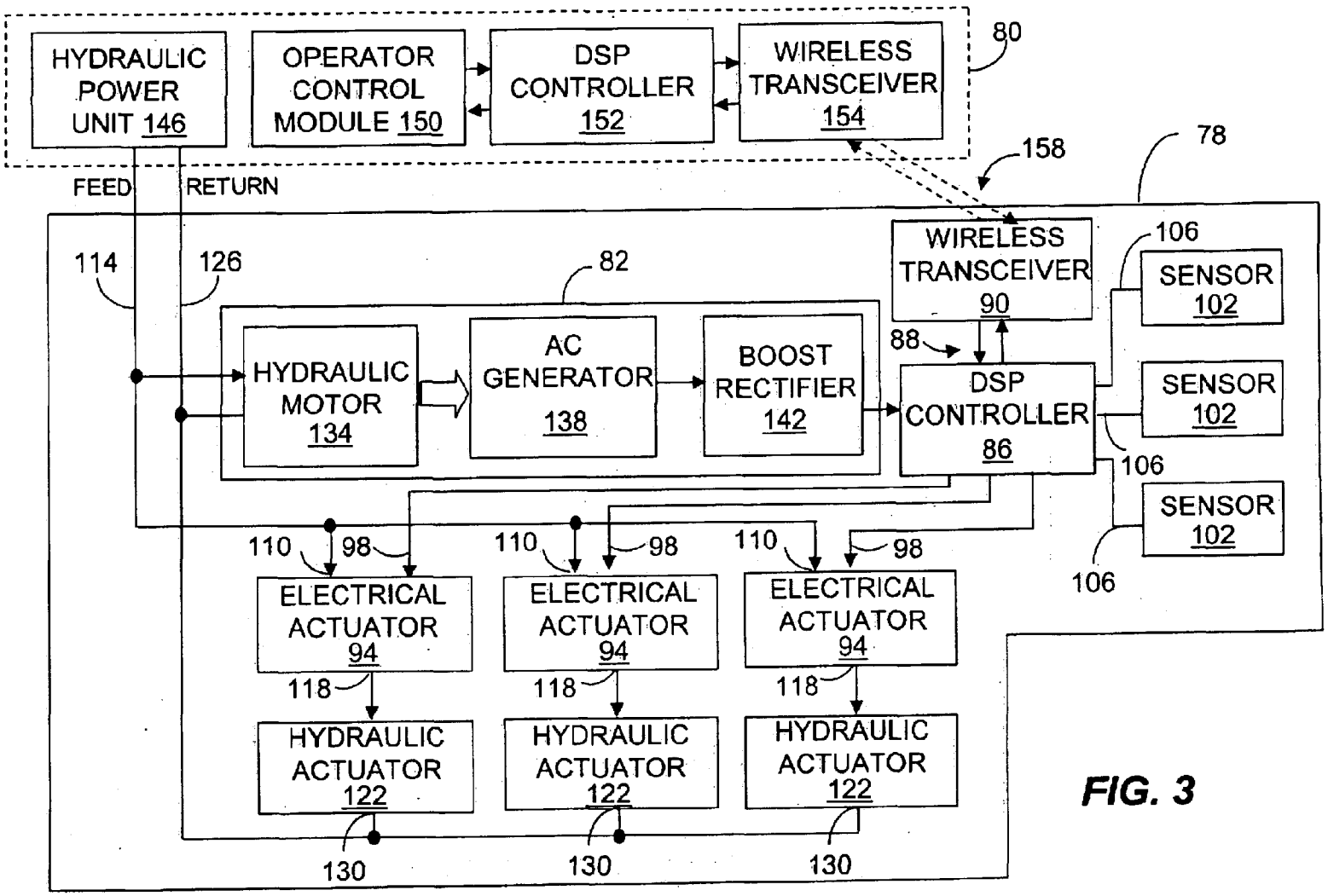
FIG. 3 is a block diagram showing an actuator system constructed in accordance with the principles of the invention.

Referring to FIG. 3, an actuator system 78 having a control apparatus in accordance with the invention includes a source of electrical power 82, a controller module 86 and a transceiver 90. There are no wires or other electrical conductors between remotely located equipment 80 (described in more detail below for FIG. 5) and the actuator system 78. The source of electrical power 82, controller module 86 and transceiver 90 can be enclosed in a single box, or housing, and mounted on a structure in the rotating portion 18 of the top drive 10 near the rotary seal 22 (see FIG. 1). The controller module 86 is implemented in a digital signal processor (DSP) and receives its power from the source of electrical power 82. The controller module 86 is coupled to the transceiver 90 (e.g., Linx Technologies model no. TR-916-SC-PA) through a bi-directional communication line 88, to electrical actuators 94 by control lines 98, and to sensors 102 by sensor lines 106. In one embodiment, the electrical actuators 94 are solenoid valves as known in the art. Each electrical actuator 94 has a hydraulic inlet 110 connected to a common hydraulic feed line 114 and a hydraulic outlet 118 that is coupled to a respective hydraulic actuator 122. The hydraulic actuators 122 are coupled to a common hydraulic return line 126 through respective hydraulic outlets 130.

The sensors 102 include indicators, or proximity switches, that sense the binary position of hydraulic actuators 122. Such sensors 102 are used to confirm that a commanded actuator function was actually performed. This confirmation can prevent operation of one or more hydraulic actuators 122 if the subsequent robotic actuator motion could risk operator safety or potentially result in equipment damage. The sensors 102 can also include one or more temperature sensors, pressure sensors, flow sensors and level switches. The sensors generate analog or digital data representing a variety of parameters, including actuator speed, hydraulic flow rate, and component binary state (e.g., whether a valve is open or closed). Analog to digital conversion of analog sensor data is performed by the controller module 86. Alternatively, analog to digital conversion capability can be integrated with the sensor 102 at the sensor location. In one embodiment, sensor data is processed at the controller module 86 and is combined in a serial data stream for transmission to a remote controller module 152 over a wireless link 158.

In the illustrated embodiment, the source of electrical power 82 includes a hydraulic motor 134 (e.g., Eaton J2 series 8.2 displacement, model no. 129-0339) mechanically coupled to an alternating current (AC) permanent magnet motor 138 (e.g., Poly-Scientific model. No. BN34-35AF-03). The electrical output of the AC motor 138 is coupled to a boost rectifier 142 which provides direct current (DC) electrical power to the controller module 86. Various forms of boost rectifiers known to those of skill in the art can be used.

Figure 4:
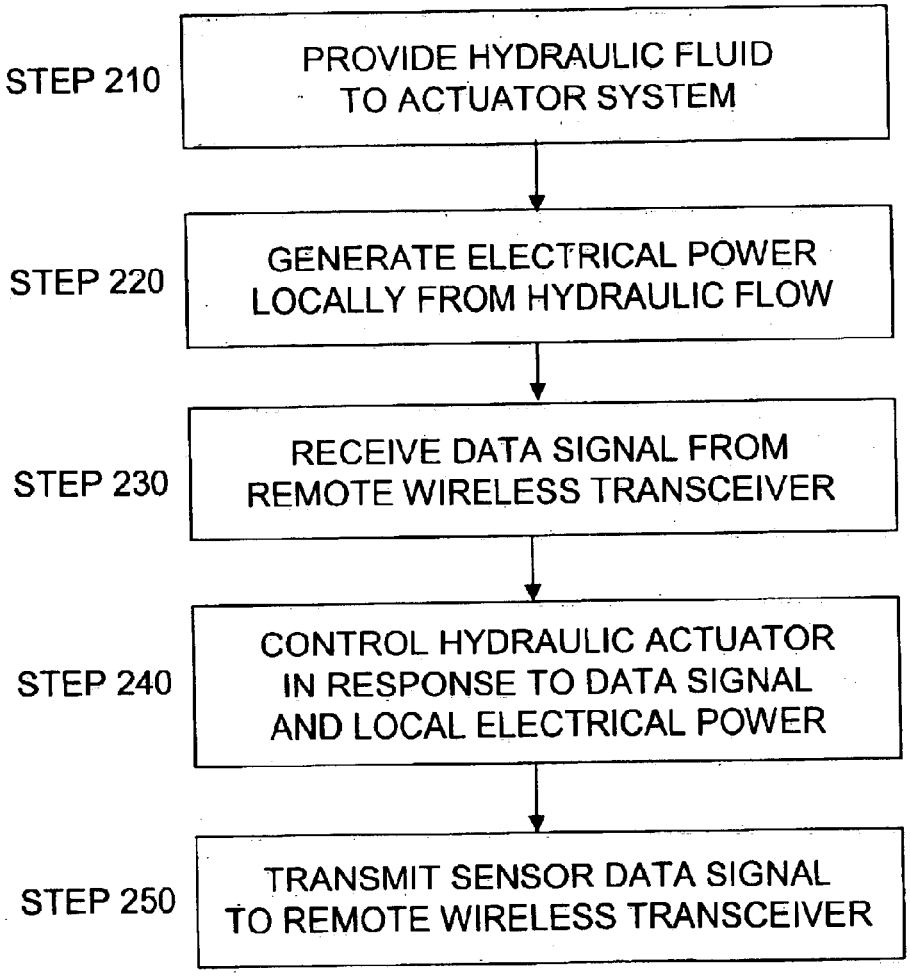
FIG. 4 is a flowchart representation of an embodiment of a method for controlling an actuator system in accordance with the principles of the invention.

Referring now to both FIG. 3 and FIG. 4, during operation of the actuator system 78 a hydraulic power unit 146 supplies (step 210) high pressure hydraulic fluid to drive the hydraulic motor 134 which, in turn, mechanically drives the AC generator 138 to generate (step 220) an AC voltage (e.g., 5 VAC). The boost rectifier 142 converts the output of the AC generator 138, which can vary by several volts from its nominal voltage value, to a regulated 24 VDC electrical power source. Electrical power is supplied to the controller module 86 and electrical actuators 94.

To achieve the desired actuator motion, an operator generates input commands at an operator control module 150. These commands are provided to a remote controller module 152 and the processed command data is transferred to a remote transceiver 154 for serial transmission over the wireless link 158 to the transceiver 90 of the actuator system 78. In one embodiment the wireless link is a radio frequency (RF) link. In another embodiment the wireless link is a free space optical link. The data received (step 230) at the local transceiver 90 is provided to the controller module 86. In response, the controller module 86 provides electrical control signals over the control lines 98 to control the electrical actuators 94. The electrical actuators 94 vary their hydraulic output flows accordingly to control (step 240) the operation of the hydraulic actuators 122. Feedback data from the sensors 102 indicating the status of the various robotic actuators is processed by the controller module 86 before being transmitted (step 250) by the local transceiver 90 to the remote transceiver 154. Processing can included noise filtering and evaluating the data to determine sensor faults, transition delays and the occurrence of multiple transitions.

Figure 5:
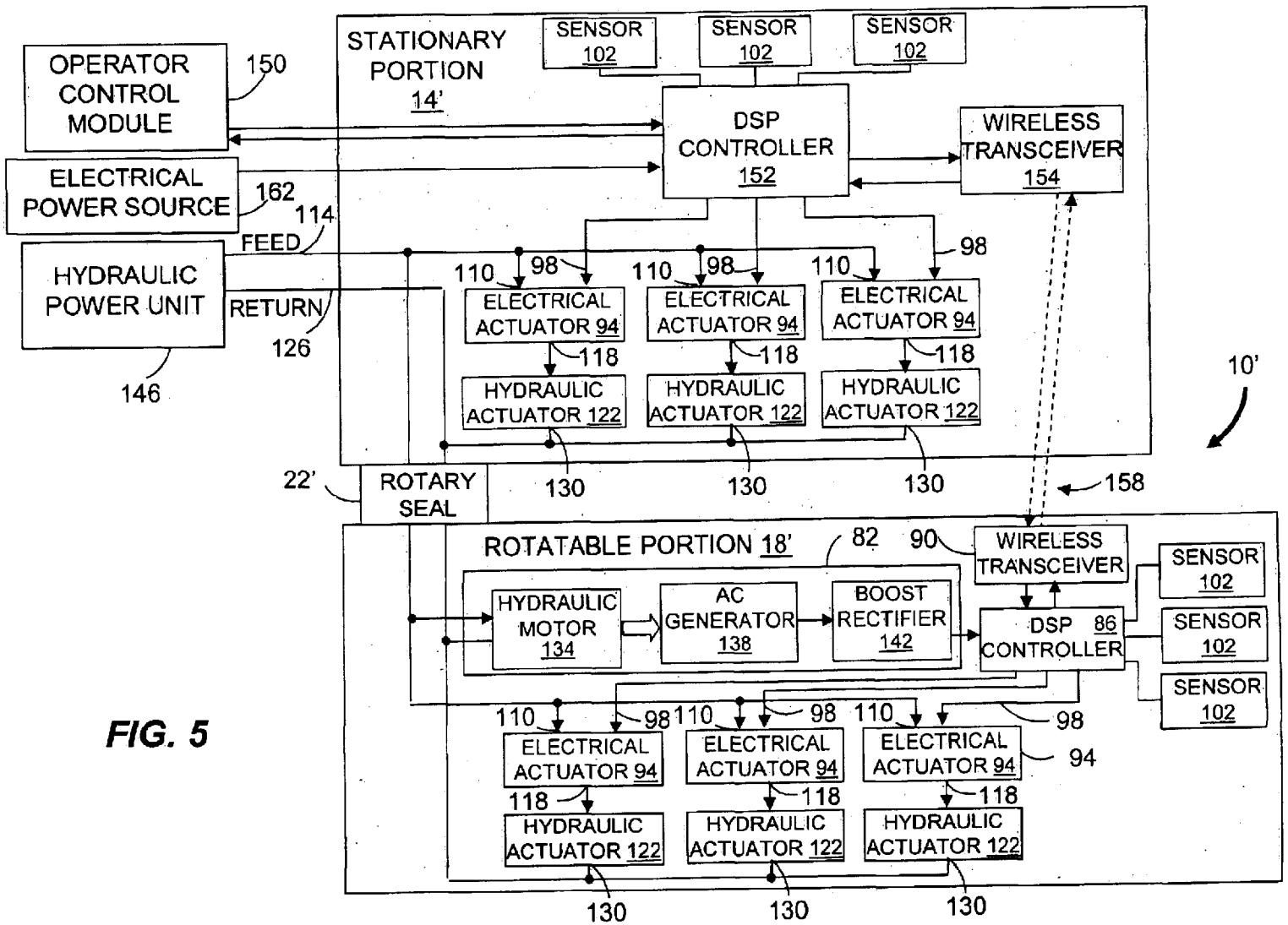
FIG. 5 is a block diagram showing an actuator system for a top drive constructed in accordance with the principles of the invention.

FIG. 5 is a block diagram of an embodiment of a top drive 10' having an apparatus for controlling the operation of an actuator system in accordance with the principles of the invention. The top drive 10' includes a stationary portion 14' hydraulically coupled to a rotating portion 18' through a rotary seal 22'. The rotating portion 18' includes the components of the actuator system 78 of FIG. 3, except for the remotely located equipment 80. The stationary portion 14' includes components similar to those depicted in the rotating portion 18', but it does not include the source of electrical power 82. The wireless transceiver 154 may be located separate from the stationary portion 14 and can be, for example, adjacent to or integrated with the operator control module 150.

An electrical power source 162 supplies power to the stationary portion 14' by a direct (i.e., wired) connection. A hydraulic power unit 146 provides hydraulic flow to the stationary portion 14' through hydraulic feed and return lines 114 and 126, respectively. A portion of the hydraulic flow is distributed to the rotating portion 18' through the two channels of a two-port rotary seal 22'. Inside the rotating portion 18', the hydraulic feed is distributed to the source of electrical power 82 and the actuators 94, 112.

To control the operation of the actuators 94, 122, an operator enters commands at the operator control module 150. The commands are forwarded to the controller module 152 through an electrical or optical link. Control signals generated by the controller module 152 in response to the commands are provided to the electrical actuators 94 in the stationary portion 14 to operate the respective hydraulic actuators 122. Additional control signals generated by the controller module 152 are forwarded to the transceiver 154 for transmission to the rotating portion 18' to operate its actuators 94, 122. Feedback data received at the transceiver 154 from the rotating portion 18' are provided to the controller module 152. The feedback data can also be provided to the operator control module 150 for display or processing.

The controller module 86 in the rotating portion 18' coordinates control signals transmitted to the electrical actuators 94 for operating the hydraulic actuators 122 in the rotating portion 18'. The controller module 86 receives feedback data generated by the local sensors 102 and sends the feedback data (after any optional processing) to the local transceiver 90 for transmission to the remote transceiver 154. The feedback data indicates, for example, the states and positions of the actuators 94, 122 and the value of other actuator system parameters.

Advantageously, the source of electrical power 82 in the rotating portion 18' of the top drive 10' means that no wires need to be routed between the two portions 14', 18'. Thus the risk of sparks and the problems of wire management are eliminated. Moreover, the rotary seal 22' does not have to accommodate a separate channel for each hydraulic actuator 122 and sensor 102. Instead, the electrical actuators 94 previously located in the stationary portion 14' for controlling the hydraulic actuators 122 in the rotating portion 18' are now integrated into the rotating portion 18'. Thus, only two hydraulic channels are required in the rotary seal 22'; one channel for the hydraulic feed and the other channel for the hydraulic return. Consequently, the reliability of the rotary seal 22' is increased and the cost decreased in comparison to rotary seals used in conventional top drive systems.

While the invention has been shown and described with reference to specific preferred embodiments, it should be understood by those skilled in the art that various changes in form and detail can be made therein without departing from the spirit and scope of the invention as defined by the following claims. For example, the principles of the invention can be applied to a variety of systems in which electrical power cannot locally be provided to the actuator system. In another example, the processing of control data and sensor data in a top drive can be performed primarily by only one of the controller modules, or alternatively shared by both controller modules. In yet another example, the wireless link between the transceivers can be an optical link.

What is claimed is:

1. An apparatus for controlling an actuator system in a rotating position of a hydraulic system, the actuator system having an electrical actuator in hydraulic communication with a hydraulic actuator and a hydraulic source, the apparatus comprising:

a rotary seal having a channel to pass a hydraulic flow from a stationary portion of the hydraulic system to the rotating portion and a channel to return the hydraulic flow from the rotating portion to the stationary portion;

a source of electrical power disposed in the rotating portion;

a controller module disposed in the rotating portion and being in electrical communication with the source of electrical power to receive power therefrom and in electrical communication with the electrical actuator; and a transceiver disposed in the rotating portion and being in communication with the controller module, the transceiver adapted for wireless communication with a remote transceiver, the wireless communication including transfer of control data and feedback data with the remote transceiver, the controller module sending a control signal to the electrical actuator in response to control data received from the remote transceiver.

2. The apparatus of claim 1 further comprising the remote transceiver.

3. The apparatus of claim 2 further comprising a remote controller module in communication with the remote transceiver.

4. The apparatus of claim 3 further comprising an operator control module in communication with the remote controller module.

5. The apparatus of claim 1 wherein the source of electrical power comprises:

a hydraulic motor in hydraulic communication with the hydraulic source; and an alternating current (AC) generator in mechanical communication with the hydraulic motor.

6. The apparatus of claim 5 wherein the source of electrical power further comprises a boost rectifier in electrical communication with the AC generator.

7. The apparatus of claim 1 wherein the controller module comprises a digital signal processor.

8. The apparatus of claim 1 further comprising a sensor in communication with the controller module.

9. The apparatus of claim 8 wherein the sensor comprises one of a proximity switch, a temperature sensor, a pressure sensor, a flow sensor and a level switch.

10. The apparatus of claim 1 further comprising the electrical actuator.

11. The apparatus of claim 10 wherein the electrical actuator is a solenoid valve.

12. An apparatus for controlling the operation of an actuator system a top drive, the actuator system having an electrical actuator and a hydraulic actuator the apparatus comprising:

a rotary seal having a channel to pass a hydraulic flow from a stationary portion of the top drive to a rotating portion of the top drive and having a channel to return the hydraulic flow from the rotating portion to the stationary portion;

a source of electrical power disposed in the rotating portion;

a first controller module disposed in the rotating portion and being in communication with the source of electrical power and the electrical actuator; and a first transceiver disposed in the rotating portion and being configured for communication with a second transceiver through a wireless communication link to transfer control data and feedback data, the first controller module sending a control signal to the electrical actuator in response to the control data.

13. The apparatus of claim 12 wherein the source of electrical power comprises:

a hydraulic motor adapted for communication with a hydraulic source in the stationary portion; and an alternating current (AC) generator in mechanical communication with the hydraulic motor.

14. The apparatus of claim 13 wherein the source of electrical power further comprises a boost rectifier in electrical communication with the AC generator.

15. The apparatus of claim 12 further comprising the second transceiver.

16. The apparatus of claim 15 further comprising a second controller module in communication with the second transceiver module.

17. The apparatus of claim 16 further comprising an operator control module in communication with the second controller module.

18. The apparatus of claim 12 further comprising a sensor in communication with the first controller module.

19. The apparatus of claim 18 wherein the sensor is one of a proximity switch, a temperature sensor, a pressure sensor, a flow sensor and a level switch.

20. A method of controlling an actuator system having a hydraulic actuator disposed in a rotating portion of a hydraulic system, the method comprising:

providing a hydraulic flow from a stationary portion of the hydraulic system to the hydraulic actuator;

generating electrical power from the hydraulic flow in the rotating portion of the hydraulic system;

receiving a data signal from a remote wireless transceiver; and controlling the hydraulic actuator in response to the received data signal and the electrical power.

21. The method of claim 20 wherein the received data signal comprises control data.

22. The method of claim 20 further comprising transmitting a data signal from the actuator system to the remote wireless transceiver.

23. The method of claim 22 wherein the transmitted data signal comprises sensor data.

24. The method of claim 23 wherein the sensor data is indicative of at least one of actuator speed, hydraulic flow rate, temperature, position and component binary state.

25. An apparatus for controlling a hydraulic actuator in a rotating portion of a hydraulic system, the apparatus comprising:

means for passing a hydraulic flow from a stationary portion of the hydraulic system to the rotating portion and for returning the hydraulic flow from the rotating portion to the stationary portion;

means disposed in the rotating portion for converting hydraulic flow to electrical power;

means disposed in the rotating portion for receiving control data from a remote transceiver over a wireless link;

means disposed in the rotating portion for generating an electrical control signal in response to the electrical power and the received control data; and means for operating the hydraulic actuator responsive to the electrical control signal.

26. The apparatus of claim 25 further comprising means for transmitting sensor data to the remote transceiver over the wireless link.

* * * * *

UNITED STATES PATENT AND TRADEMARK OFFICE

CERTIFICATE OF CORRECTION

PATENT NO. : 6,925,807 B2
DATED : May 12, 2005
INVENTOR(S) : Jones et al.

It is certified that error appears in the above-identified patent and that said Letters Patent is hereby corrected as shown below:

Column 6,
Line 66, "position" should be changed to -- portion --.

Signed and Sealed this

Eleventh Day of October, 2005

JON W. DUDAS
*Director of the United States Patent and Trademark Office*